United States Patent [19]

Adams

[11] 4,155,858

[45] May 22, 1979

[54] GREASE CONTAINING BORATE EP ADDITIVES

[75] Inventor: John H. Adams, San Rafael, Calif.

[73] Assignee: Chevron Research Company, San Francisco, Calif.

[21] Appl. No.: 901,940

[22] Filed: May 1, 1978

Related U.S. Application Data

[63] Continuation-in-part of Ser. No. 777,368, Mar. 14, 1977, abandoned.

[51] Int. Cl.[2] ..... C10M 3/18; C10M 5/14; C10M 7/20; C10M 7/24

[52] U.S. Cl. ..... 252/18; 252/25

[58] Field of Search ..... 252/18, 25

[56] References Cited

U.S. PATENT DOCUMENTS

| | | | |
|---|---|---|---|
| 3,243,372 | 3/1966 | Dreher et al. | 252/51.5 A |
| 3,853,772 | 12/1974 | Adams | 252/25 |
| 3,907,691 | 9/1975 | King et al. | 252/25 |
| 3,983,042 | 9/1976 | Jain et al. | 252/25 |
| 3,988,248 | 10/1976 | Grasshoff | 252/25 |
| 3,997,454 | 12/1972 | Adams | 252/25 |
| 4,100,080 | 7/1978 | Adams | 252/18 |
| 4,100,081 | 7/1978 | Dreher et al. | 252/25 |

*Primary Examiner*—Delbert E. Gantz
*Assistant Examiner*—Irving Vaughn
*Attorney, Agent, or Firm*—D. A. Newell; C. J. Tonkin; J. Tedd Brooks

[57] ABSTRACT

Greases are provided which contain as EP additives sodium and potassium borates containing limited quantities of water.

6 Claims, No Drawings

GREASE CONTAINING BORATE EP ADDITIVES

CROSS REFERENCE TO RELATED APPLICATION

This application is a continuation-in-part of U.S. patent application Ser. No. 777,368, filed Mar. 14, 1977 abandoned.

BACKGROUND OF THE INVENTION

Field of the Invention

This application is concerned with grease compositions containing as extreme-pressure (EP) additives sodium and potassium borates of limited water content and a boron to alkali metal ratio greater than 2.5.

Modern technology is currently supplying the general public and the process industries with machinery which is designed to operate under a wider range of temperatures and under greater loads than previously available. In addition, many of the newer machines are designed to operate at extremely high speeds. Many of these machines require certain specific lubricating properties which are not available in the conventional lubricants. Thus, modernization of high-speed and high-temperature equipment has strained the petroleum industry for the development of a second generation of lubricants capable of satisfying the requirements of the new machines. Recently, for example, there has been an increased demand for lubricants capable of performing well at temperatures above 300° F. in high-speed bearings and gears for periods in excess of 500 hours. In addition, with the further development of the high-speed sealed bearings, the lubricant must be able to endure for the life of the bearing.

There have been numerous grease compositions developed which satisfy most of the new, more stringent requirements. Many of these compositions, however, are entirely too expensive for commercialization or only meet some of the lubricating requirements and fail in others. One type of lubricant currently available is the lithium greases. These greases are simply a mixture of a hydrocarbon base oil and a lithium soap such as lithium hydroxy stearate with minor amounts of other additives. These greases exhibit good lubricating properties and perform well at moderate temperatures.

Another type of grease composition which has excellent lubricating properties at the higher temperatures is comprised of a lubricating oil (natural or synthetic) containing a polyurea additive. This type of lubricant is disclosed in U.S. Pat. Nos. 3,242,210, 3,243,372, 3,346,497 and 3,401,027, all assigned to Chevron Research Company. The polyurea component imparts a significant high-temperature stability to the grease and in fact effects a mild anti-thixotropic property, i.e., increases in viscosity with increasing shear, to the lubricant. This property of the lubricant is advantageous to prevent the segregation or loss of grease from the moving parts of the machine. However, the polyurea component does not impart extreme-pressure properties to the lubricant and, accordingly, EP additives must be added in applications involving high contact pressures. A need therefore exists for a grease composition which can be used in high-temperature and high-speed applications that exhibits good stability over prolonged periods, that exhibits both extreme-pressure and antiwear properties, and that is relatively inexpensive to produce. Other greases which often need extreme-pressure properties are the well-known sodium terephthalamates, aluminum-, calcium- and sodium-based types.

In the past a variety of agents have been employed as EP agents in greases. However, many of these compounds are corrosive to metal. Included among these are phosphorus, sulfur, and chlorine-containing additives such as phosphates, sulfurized olefins, sulfurized aromatic compounds, chlorinated hydrocarbons, etc. In addition, lead compounds have been employed as EP additives. Enviromental concerns have, however, made it desirable to eliminate lead-containing additives from greases. Alkali metal borates, specifically sodium metaborate, have been incorporated in various greases as EP agents with varying degrees of success.

It is thus desirable that grease compositions be provided which possess good EP and antiwear characteristics achieved without enhancement of metal corrosivity and without toxicological problems.

SUMMARY OF THE INVENTION

It has now been found that excellent EP greases comprise a major portion of an oil of lubricating viscosity, a minor portion of a grease thickener sufficient to thicken the oil to grease consistency, and a minor portion sufficient to impart EP properties to the grease of a borate of the empirical formula $$MB_xO_y(H_2O)_z$$

in which M is Na or K, x is 2.5 to 6, preferably 2.5 to 3.5, y is 4.25 to 9.5, preferably 4.5 to 5.7, and z is 0.1 to 5, preferably 0.5 to 3.

The additives are prepared by reacting boric acid and potassium or sodium hydroxide in an appropriate ratio of boron to alkali metal and heating the product at elevated temperature for a time sufficient to remove water to the desired extent. The reaction is carried out in aqueous medium at as high a reactant concentration as possible to minimize the amount of water that must be removed. Heating of the solid mass after liquid water is removed is preferably carried out at temperatures above 300° F. and usually above 400° F.

The product is comminuted to powder form and simply dispersed in the grease by conventional means at a temperature of 100° to 250° F., usually about 140°-180° F.

The preferred limits of the water to alkali metal atom (Z/M or Z since M=1) of 0.5 to 3 represent the most practical applications in grease. Reducing the water content below Z=0.5 is extremely difficult and as will be shown, when Z is above 3, a commercial lithium hydroxy stearate grease containing the borate becomes liquid when heated at 400° F. Although liquefaction may be overcome by the use of additional thickening agent, this represents a less practical approach, and it is generally useful to maintain the water content within the preferred range.

Grease Thickeners

The grease thickeners which are employed in the compositions of this invention include a wide variety of materials which are organic thickeners and inorganic thickeners.

Thus, the thickeners include various soaps and the polyureas. Included in the soap-type thickeners are lithium, sodium, aluminum and calcium soaps.

The grease thickeners thus include various organic metal salts as well as non-metallic organic thickeners such as the polyureas. Most commonly employed are the organic metal salts, which may be represented by the formula:

$$(RX)_nM$$

wherein R represents a saturated or unsaturated alkyl group of an aralkyl group, the R group having from 10 to 30 carbon atoms, 16 to 22 carbon atoms being preferred; X represents a carboxy group, (i.e., a

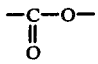

group), a phosphonyl group (i.e., a

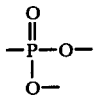

group), a sulfonyl group (i.e., a

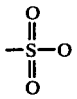

group), or a sulfate group (i.e., a

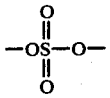

group); and M represents a metal of Groups I and II of the Periodic Table. Specifically, M may be sodium, potassium, lithium, calcium, barium or strontium. However, it is preferred that M be of Group I of the Periodic Table, sodium and potassium being preferred. n represents an integer having a value of 1 or 2, depending on whether M is monovalent or divalent. When M is monovalent, n has a value of one; when M is divalent, n has a value of two.

The R group may be substituted by polar groups such as chlorine, bromine, alkoxy, hydroxy, mercapto, etc.

Examples of the organic acids which may be used in the formation of the metal salts include lauric acid, myristic acid, palmitic acid, stearic acid, oleic acid, arachidic acid, melissic acid, phenylacetic acid, cetylbenzoic acid, acids resulting from the oxidation of petroleum products (e.g., waxes), centanesulfonic acid, dodecylbenzenesulfonic acid, dodecanephosphonic acid and lauryl sulfuric acid. Acids of lower molecular weight, such as acetic acid and the like, may be admixed with the acids forming the thickening agents upon conversion to the metal salt, which lower-molecular-weight acids often beneficially modify the characteristics of the grease compositions.

The organic acid metal salt thickening agent is incorporated in the composition of this invention in amounts sufficient to form the grease. Such amounts as about 1% to about 50% (based on the finished composition) may be used. However, about 3% to about 30% are the preferred amounts.

The preferred thickening agents are the lithium soaps, most preferably lithium 12-hydroxy stearate.

The lithium greases are described in U.S. Pat. Nos. 2,274,673; 2,274,674; 2,274,675; 2,274,676 and 2,293,052.

Aluminum grease thickeners are described in U.S. Pat. Nos. 2,599,553; 2,654,710; 2,768,138; 3,345,291; 3,476,684; and 3,725,275.

Other suitable thickeners are the polyureas disclosed in U.S. Pat. Nos. 3,242,210; 3,243,372; 3,346,497 and 3,401,027, all assigned to Chevron Research Company.

Base Oil

The third component which must necessarily be present in the composition of this invention is a liquid base oil. The base oils which may be employed herein include a wide variety of lubricating oils such as naphthenic-base, paraffin-base, and mixed-base lubricating oils. Other hydrocarbon oils include lubricating oils derived from coal products and synthetic oils, e.g., alkylene polymers (such as polymers of propylene, butylene, etc., and mixtures thereof), alkylene oxide-type polymers (e.g., alkylene oxide polymers prepared by polymerizing alkylene oxide, e.g., propylene oxide polymers, etc., in the presence of water or alcohols, e.g., ethyl alcohol), carboxylic acid esters (e.g., those which were prepared by esterifying such carboxylic acids as adipic acid, azelaic acid, suberic acid, sebacic acid, alkenyl succinic acid, fumaric acid, maleic acid, etc., with the alcohols such as butyl alcohol, hexyl alcohol, 2-ethylhexyl alcohol, etc.), liquid esters of acid of phosphorus, alkylbenzenes, polyphenols (e.g., bisphenols and terphenols), alkyl bisphenol ethers, polymers of silicon, e.g., tetraethyl silicate, tetraisopropyl silicate, tetra(4-methyl-2-tetraethyl) silicate, hexyl(4-methyl-2-pentoxy) disilicone, poly(methyl) siloxane, and poly(methylphenyl) siloxane, etc. The base oils may be used individually or in combinations, whenever miscible or whenever made so by use of mutual solvents.

Other Additives

In addition to the mono- or polyurea and alkaline earth metal carboxylate, other additives may be successfully employed within the grease composition of this invention without affecting its high stability and performance over a wide temperature scale. One type of additive is an antioxidant or oxidation inhibitor. This type of additive is employed to prevent varnish and sludge formation on metal parts and to inhibit corrosion of alloyed bearings. Typical antioxidants are organic compounds containing sulfur, phosphorus or nitrogen, such as organic amines, sulfides, hydroxy sulfides, phenols, etc., alone or in combination with metals such as zinc, tin or barium. Particularly useful grease antioxidants include phenyl-alpha-napthylamine, bis(alkylphenyl)amine, N,N-diphenyl-p-phenylene diamine, 2,2,4-trimethyldihydroquinoline oligomer, bis(4-isopropylaminophenyl) ether, N-acyl-p-aminophenol, N-acylphenothiazines, N-hydrocarbylamides of ethylene diamine tetraacetic acid, alkylphenol-formaldehyde-amine polycondensates, etc.

Another additive which may be incorporated into the grease composition of this invention is an anti-corrodant. The anti-corrodant is employed to suppress attack by acidic bodies and to form protective films over the metal surfaces which decrease the effect of corrosive materials on exposed metallic parts. A particularly effective corrosion inhibitor is an alkali metal nitrite and preferably sodium nitrite. The combination of the polyurea thickener and alkaline earth metal carboxylate has been found to work exceedingly well within the alkali metal nitrite. When this corrosion inhibitor is employed, it is usually used at a concentration of 0.1 to 5 weight percent and preferably from 0.2 to 2 weight percent, based on the weight of the final grease composition.

Another type of additive which may be employed herein is a metal deactivator. This type of additive is employed to prevent or counteract catalytic effects of metal on oxidation generally by forming catalytically inactive complexes with soluble or insoluble metal ions. Typical metal deactivators include complex organic nitrogen and sulfur-containing compounds such as certain complex amines and sulfides. An exemplary metal deactivator is mercaptobenzothiazole.

In addition to the above, several other grease additives may be employed in the practice of this invention and include stabilizers, tackiness agents, dropping point improvers, lubricating agents, color correctors, odor control agents, etc.

Clay thickeners are described in Boner, "Manufacture and Application of Lubricating Greases," Reinhold Publishing Corp., 1954, at p. 679. The clay used is usually bentonite.

EXAMPLES

The following examples illustrate the invention. The examples are only illustrative and are non-limiting.

EXAMPLE 1

Preparation of Borate Additive 52 g of KOH and 145 g boric acid were dissolved in 200 ml water and heated to drive off water. Heating on a hot plate (surface temperature of 600° F.) for 3 hours yielded 140.0 g of $KB_3O_5.H_2O$

EXAMPLE 2

Incorporation of Borate Additive in Grease

The materials prepared as in Example 1 were ground with a mortar and pestle and incorporated by stirring into various base greases at a temperature of about 180° F. The greases were then passed through a 3-roll mill.

The greases prepared above were subjected to Timken Test (ASTM D-2509), Penetration P-60 (ASTM D-1403) and Load Wear Index and True Weld Point (ASTM D-2596) were obtained. The greases were commercial greases. These data are shown in the following Table. For comparison, data were obtained on greases containing additives having water contents outside the preferred limits (Examples 1 and 2) and boron to alkali metal ratios outside the limits of the invention (Tests 3 and 5), and a grease containing a conventional lead EP additive (Test 9).

ALKALI METAL BORATE EP CREASES

| Composition | Crease Type, % | Borate, % |
|---|---|---|
| 1 | Lithium Hydroxystearate, 96 | $NaBO_2 . 4H_2O$, 4 |
| 2 | Lithium Hydroxystearate, 96 | $Na_2B_4O_7 . 10H_2O$, 4 |
| 3 | Lithium Hydroxystearate, 96 | $Na_2B_4O_7 . 2.5H_2O$, 4 |
| 4 | Lithium Hydroxystearate, 96 | $NaB_3O_5 . 3H_2O$, 4 |
| 5 | Lithium Hydroxystearate, 96 | $K_2B_4O_7 . 3H_2O$, 4 |
| 6 | Lithium Hydroxystearate, 96 | $KB_3O_5 . H_2O$, 4 |
| 7 | Lithium Hydroxystearate, 98 | $KB_3O_5 . H_2O$, 2 |
| 8 | Lithium Hydroxystearate, 98 | Aqueous $KB_3O_5$ (Dehydrated In Situ) |
| 9* | Lithium Hydroxystearate, 89.7 | — |
| 10 | Aluminum Complex, 96 | $KB_3O_5 . H_2O$, 4 |
| 11 | Sodium n-octadecyl Terephalamate, 96 | $KB_3O_5 . H_2O$, 4 |
| 12 | Clay, 96 | $KB_3O_5 . H_2O$, 4 |

| Tests | Composition 1 | 2 | 3 | 4 | 5 | 6 | 7 | 8 | 9 | 10 | 11 | 12 |
|---|---|---|---|---|---|---|---|---|---|---|---|---|
| Penetration, 60 strokes | 349 | 342 | 342 | 342 | 334 | 341 | 345 | 441 | 313 | 225 | 347 | 292 |
| Timken OK Load, lbs. | 30 | 30 | | 40 | 30 | 45 | 45 | | 55 | | | |
| Load Wear Index, lbs. | | | 72.8 | 80.6 | 70 | 102 | 56.4 | | 34.5 | 47.6 | 76.4 | 46.7 |
| True Weld Point, kg | | | 260 | 335 | 305 | 400 + | 250 | | 265 | 175 | 280 | 150 |
| $P_{60}$ after heating in mixer to 300° F. | liquid | liquid | liquid | 400 | 346 | 442 | | | 368 | | | |
| Thin film, dry, 275° F. | 25 | 49 | 29 | 23 | | 35 | 25 | | 8 | | | |

*Contains 10.3% lead EP additives.

As can be seen from these data, Tests 1, 2 and 3 produced liquid materials after heating to 300° F. The EP values for the materials containing the additives of the invention were excellent.

The above examples and data are intended to be illustrative only. It will be apparent to those skilled in the art that there are many embodiments of the compositions described above which are within the scope and spirit of the invention.

What is claimed is:

1. A grease composition comprising a major portion of an oil of lubricating viscosity, a minor portion sufficient to thicken said oil to grease consistency of a grease thickener, and a minor portion sufficient to impart BP properties to the grease of a borate of the empirical formula $$MB_xO_y(H_2O)_z$$

in which M is Na or K, x is a number from 2.5 to 6, y is a number from 4.25 to 9.5 and z is a number from 0.1 to 5.

2. The grease of claim 1 in which z is a number from 1 to 3.

3. The grease of claim 1 in which M is K.

4. The grease of claim 1 in which the grease thickener is a lithium soap.

5. The grease of claim 4 in which the thickener is lithium-12-hydroxy stearate.

6. The grease of claim 1 in which x is 2.5 to 3.5, y is 4.25 to 5.7, and z is 0.5 to 3.

* * * * *